US008923939B2

(12) United States Patent
Kawashima

(10) Patent No.: US 8,923,939 B2
(45) Date of Patent: Dec. 30, 2014

(54) SUPERCONDUCTION APPARATUS

(75) Inventor: Hiroshi Kawashima, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 618 days.

(21) Appl. No.: 12/622,727

(22) Filed: Nov. 20, 2009

(65) Prior Publication Data

US 2011/0130293 A1 Jun. 2, 2011

(30) Foreign Application Priority Data

Nov. 21, 2008 (JP) ..... 2008-298489

(51) Int. Cl.
*H01F 6/06* (2006.01)
*H01F 6/04* (2006.01)

(52) U.S. Cl.
CPC ..... *H01F 6/04* (2013.01)
USPC ..... 505/163

(58) Field of Classification Search
USPC ..... 505/163
See application file for complete search history.

(56) References Cited

U.S. PATENT DOCUMENTS

| | | | | |
|---|---|---|---|---|
| 4,863,577 | A * | 9/1989 | Fazlin et al. | 204/192.32 |
| 5,216,889 | A * | 6/1993 | Herd et al. | 62/51.1 |
| 5,787,714 | A * | 8/1998 | Ohkura et al. | 62/51.1 |
| 2006/0104419 | A1* | 5/2006 | Sasayama et al. | 378/145 |
| 2008/0119362 | A1* | 5/2008 | Ashibe et al. | 505/211 |
| 2010/0113282 | A1* | 5/2010 | Kawashima | 505/163 |
| 2010/0323900 | A1* | 12/2010 | Kawashima | 505/211 |

FOREIGN PATENT DOCUMENTS

| | | | |
|---|---|---|---|
| JP | 1141397 | A | 6/1989 |
| JP | 08-078737 | A | 3/1996 |
| JP | 9312210 | A | 12/1997 |
| JP | 10-321430 | A | 4/1998 |
| JP | 10104376 | A | 4/1998 |
| JP | 2001-068328 | A | 3/2001 |
| JP | 2004179550 | A | 6/2004 |
| JP | 2006108560 | A | 4/2006 |
| JP | 2006324325 | A | 11/2006 |
| JP | 2007-078310 | A | 3/2007 |
| JP | 2010503984 | A | 2/2010 |

OTHER PUBLICATIONS

Machine Translation of JP 09-312210, 1997.*
Office Action in corresponding Japanese Application No. 2008-298489, mailed Dec. 14, 2012 (English Language Version and Japanese Language Version).
Decision to Grant a Patent mailed May 24, 2013 corresponding to Japanese patent application No. 2008-298489.

* cited by examiner

*Primary Examiner* — Paul Wartalowicz
(74) *Attorney, Agent, or Firm* — Manabu Kanesaka; Benjamin J. Hauptman

(57) ABSTRACT

A superconduction apparatus includes: a superconductor; a first vacuum vessel configured to accommodate said superconductor; a cooling unit which comprises a cold head configured to generate a temperature at which the superconductor is set to a superconduction state; and a second vacuum vessel configured to accommodate the cooling unit. The head and the superconductor are connected through a first connection hole which communicates the first vacuum vessel and the second vacuum vessel.

11 Claims, 6 Drawing Sheets

SUPERCONDUCTION APPARATUS

INCORPORATION BY REFERENCE

This patent application claims a priority on convention based on Japanese Patent Application No. 2008-298489. The disclosure thereof is incorporated herein by reference.

TECHNICAL FIELD

The present invention relates to a superconduction apparatus, and more particularly, relates to an accommodating structure for the superconductor.

BACKGROUND ART

In various apparatuses using a superconductive material for a main portion, when a conventional metal superconductive wire is used, the wire must be cooled to a liquid helium temperature close to absolute zero. In such apparatuses, since a margin between a use environment temperature and a critical temperature at which superconductivity of the superconductive wire is lost is small, cooling is performed by immersion cooling or forced circulating cooling of liquid helium.

On the contrary, in recent years, a high-temperature superconductive wire which can be put into a superconducting state with liquid nitrogen having the absolute temperature of 77k have been developed. Such a superconductive wire can stably obtain a superconductive condition through conduction cooling of the superconductor by an ultra-low temperature refrigerator.

FIG. 1 shows an example of a superconduction apparatus using such a superconductive wire. The superconduction apparatus 101 includes a vacuum adiabatic vessel (cryostat) 102. The inside of the vacuum adiabatic vessel 102 is put into a vacuum state by evacuation through an exhaust port 108. A superconducting coil 103 is arranged within the vacuum adiabatic vessel 102. The superconducting coil 103 is cooled by a superconducting coil cooling refrigerator 105. An internal surface of the vacuum adiabatic vessel 102 is covered with a radiation shield. The radiation shield is cooled by a radiation shield cooling refrigerator 106. The superconducting coil 103 is electrically connected to an external electrical apparatus through a current lead 104. An internal state of the vacuum adiabatic vessel 102 is monitored by a measuring unit arranged at a measurement port 107. The high-temperature superconductive wire material can be cooled by such a unit.

In the superconduction apparatus, the superconductor is also used for a current lead for supplying power to a main part as well as for the main part which performs a basic function of the device. The ultra-low temperature refrigerator is used to cool the superconductor and remove heat entered from the outside.

FIG. 2 shows an example of the current lead of the superconduction apparatus. The vacuum adiabatic vessel 110 is hermetically sealed by fixing a lid 114 with an opening flange 115. The vacuum adiabatic vessel 110 includes a manhole 113. An internal surface of the vacuum adiabatic vessel 110 is covered with a radiation heat shield member 112. The inside of the vacuum adiabatic vessel 110 is put into a vacuum state by evacuation through an evacuating and dry gas injecting port 127. An internal superconductor 111 is arranged within the vacuum adiabatic vessel 110. The internal superconductor 111 is connected to a cold head 117 of an internal superconductor cooling apparatus 116 through a cooling conductor 118. The internal superconductor cooling apparatus 116 is an ultra-low temperature refrigerator for cooling the internal superconductor 111 to a temperature for keeping the internal superconductor 111 in the superconducting state.

A conductor of the internal superconductor 111 is further connected to one end of a superconduction current lead 123 through a conductor 124. The other end of the superconduction current lead 123 is connected to a normal conduction current lead 121. A cooling conductor 122 cools a connection between the superconduction current lead 123 and the normal conduction current lead 121. The other end of the normal conduction current lead 121 is connected to a conductor 120 outside of the vessel 110. An end of the conductor 120 is used as an external power supply system interface. The internal superconductor 111 is electrically connected to an external electrical apparatus through the conductor 124, the superconduction current lead 123, the normal conduction current lead 121 and the conductor 120. The cooling conductor 122 is connected to a cold head 126 of a current lead cooling unit 125. The current lead cooling unit 125 cools the superconduction current lead 123 through the cooling conductor 122 so as to put the lead 123 into the superconduction state.

In such a superconduction apparatus, the cold head 117 of the internal superconductor cooling apparatus 116, the internal superconductor 111, the cold head 126 of the current lead cooling unit 125 and the cooling conductor 118 are accommodated in the common vacuum adiabatic vessel 110. In building and maintenance of the refrigerator and the current lead, in a state which the temperatures of the superconductor and the cooling conductor are increased, a person enters the inside of the vessel from the manhole 113 and performs connecting and disconnecting operations. An assembly of the superconductor and the refrigerator is previously assembled and installed in the vacuum adiabatic vessel 110 through the opening flange by opening it.

In order to improve a low-temperature strength and reduce gas generation which causes lowering of the degree of vacuum, a vacuum shield vessel in such superconduction apparatus has a welded assembly structure made of stainless steel. Mounting seats for external units such as a refrigerator and a current lead, an opening flange and a mounting seat for the manhole are airtightly sealed with an O-ring or the like.

The ultra-low temperature refrigerator can cool a front cooling head portion to ultra low temperature through adiabatic expansion of helium gas. The cooling conductor 118 is made of material such as copper, which is easy to conduct heat and electricity.

An evacuating and dry gas injecting port 127 is also used to introduce dry air or dry nitrogen gas into the vacuum adiabatic vessel 110 for breaking for breaking the vacuum state and raising the internal temperature while preventing dew formation. After completion of the operation, the following evacuation is performed and then initial cooling is performed from a room temperature state to an ultra-low temperature state over a long time.

The superconduction apparatus shown in FIGS. 1 and 2 have following problems.

(1) In the operation of connecting an ultra-low temperature refrigerator, an internal superconductor and a current lead, an operator needs to enter into the vacuum adiabatic vessel and performs complicated operations in a narrow closed space, which is inefficient. In addition, the entire inside of the apparatus needs to be opened, which is also inefficient.

(2) In order to secure a space for accommodating the ultra-low temperature refrigerator and the current leads in the vacuum adiabatic vessel for the internal superconductor, it is needed to increase the size of the vessel. Since these units are dispersively arranged, useless spaces are generated.

(3) In a maintenance operation such as inspection and exchange of the ultra-low temperature refrigerator and the current lead, it takes a long time to break the vacuum state of the vacuum adiabatic vessel, raise the temperature of the internal superconductor and initial cooling of the superconductor and the cooling conductor after completion of the above-mentioned operation. Accordingly, it is need to stop the apparatus for a long time, leading to a large economic loss.

(4) A working space needs to be secured in the vacuum adiabatic vessel which accommodates the internal superconductor therein. For this reason, there are the constraints of a shortest cooling path from the ultra-low temperature refrigerator to the superconductor and the number of installed ultra-low temperature refrigerators.

In conjunction with the above description, a superconducting magnet apparatus is described in Japanese Patent Publication JP 2006-324325A (the first conventional example), in which the magnet apparatus is accommodated in a vacuum adiabatic vessel and includes a superconducting coil dipped in liquid helium or having a conduction cooling structure without use of liquid helium. In the magnet apparatus, a current lead for leading a current from an external power supply to the superconducting coil includes a room-temperature side current lead of copper or copper alloy, a middle current lead of high-temperature superconductor, and a low-temperature side current lead of high-temperature superconductor which are connected in series. The middle current lead and the low-temperature side current lead are arranged in a adiabatic vacuum region, and a connection between the middle current lead and the low-temperature side current lead is cooled by a small-size refrigerator, without passing cooling gas or liquid through the insides of these current leads.

Also, a vacuum vessel for nuclear fusion is described in Japanese Patent Publication JP-a-Heisei 10-104376 (the second conventional example), in which the vacuum vessel confines plasma and is divided into sectors in a torus direction, and a dross receiver is provided outside the sector along the division plane.

Also, a division type tubular magnetic shield apparatus is described in Japanese Patent Publication JP 2004-179550A (the third example), in which the magnetic shield apparatus has a plurality of C-shaped shaking blocks which are combined to form a magnetic shield space in the inside and each of which has a C-shaped lateral cross section and a predetermined length in an axial line direction. The C-shaped shaking block includes a magnetic material layer having an angular magnetization characteristic and a coil wound at least a part of an inner layer or an outer layer of the magnetic material layer to supply magnetic shaking current to the C-shaped shaking block.

Also, a nuclear fusion apparatus is described in Japanese Patent No. 2,633,876 (the fourth conventional example), in which the nuclear fusion apparatus includes a vacuum vessel of a hollow annular shape, a plurality of superconducting toroidal magnetic field coils, and a vacuum adiabatic vessel. The vacuum vessel is supported to a base and plasma is confined therein. The plurality of coils surround the vacuum vessel and are arranged in a torus circumferential direction in a predetermined interval, and are supported to the base by adiabatic supporting columns. The vacuum adiabatic vessel accommodates the coils and the vacuum vessel. Each of the superconducting toroidal magnetic field coil and the vacuum vessel is supported movably in a horizontal direction by three or more oscillation preventing support units arranged on the torus circumference in an equal interval. Each of the support units includes movable attaching sections, a fixed attaching section and connecting members. The movable attaching sections are provided for each of outer circumference sections of the coil and the vacuum vessel in an equal pitch. The fixed attaching section is provided for the adiabatic vacuum vessel on a line in a torus tangent direction perpendicular to a line between the movable attaching section and a torus center. The connecting member connects the movable attaching section and the fixed attaching section. A set of the movable attaching section and the connecting member, or a set of the fixed attaching section and the connecting member are rotatably coupled by a pin.

SUMMARY OF THE INVENTION

In an aspect of the present invention, a superconduction apparatus includes: a superconductor; a first vacuum vessel configured to accommodate said superconductor; a cooling unit which comprises a cold head configured to generate a temperature at which the superconductor is set to a superconduction state; and a second vacuum vessel configured to accommodate the cooling unit. The head and the superconductor are connected through a first connection hole which communicates the first vacuum vessel and the second vacuum vessel.

In another aspect of the present invention, the second vacuum vessel includes an openable lid.

In further another aspect of the present invention, the superconduction apparatus further includes a partition wall provided to decrease an opening area of the first connection hole.

In further another aspect of the present invention, the superconduction apparatus further includes a hermetic seal provided to seal the first connection hole.

In further another aspect of the present invention, the superconduction apparatus further includes a vacuum unit configured to evacuate each of the first vacuum vessel and the second vacuum vessel individually.

In further another aspect of the present invention, the superconduction apparatus further includes: a current lead configured to electrically connect the superconductor with an external terminal; a current lead cooling unit configured to cool the current lead; and a third vacuum vessel configured to accommodate the current lead cooling unit. The current lead and the superconductor are connected through a second connection hole which communicates the first vacuum vessel and the third vacuum vessel.

In further another aspect of the present invention, the third vacuum vessel includes an openable lid.

In further another aspect of the present invention, the superconduction apparatus further includes a switch configured to control a connection between the superconductor and the current lead cooling unit.

According to the present invention, peripheral apparatuses of the superconductor can be inspected and exchanged while preventing the temperature of the superconductor from rising and an operation stop time of the superconduction apparatus can be shortened.

DESCRIPTION OF THE EMBODIMENTS

Figure 3:
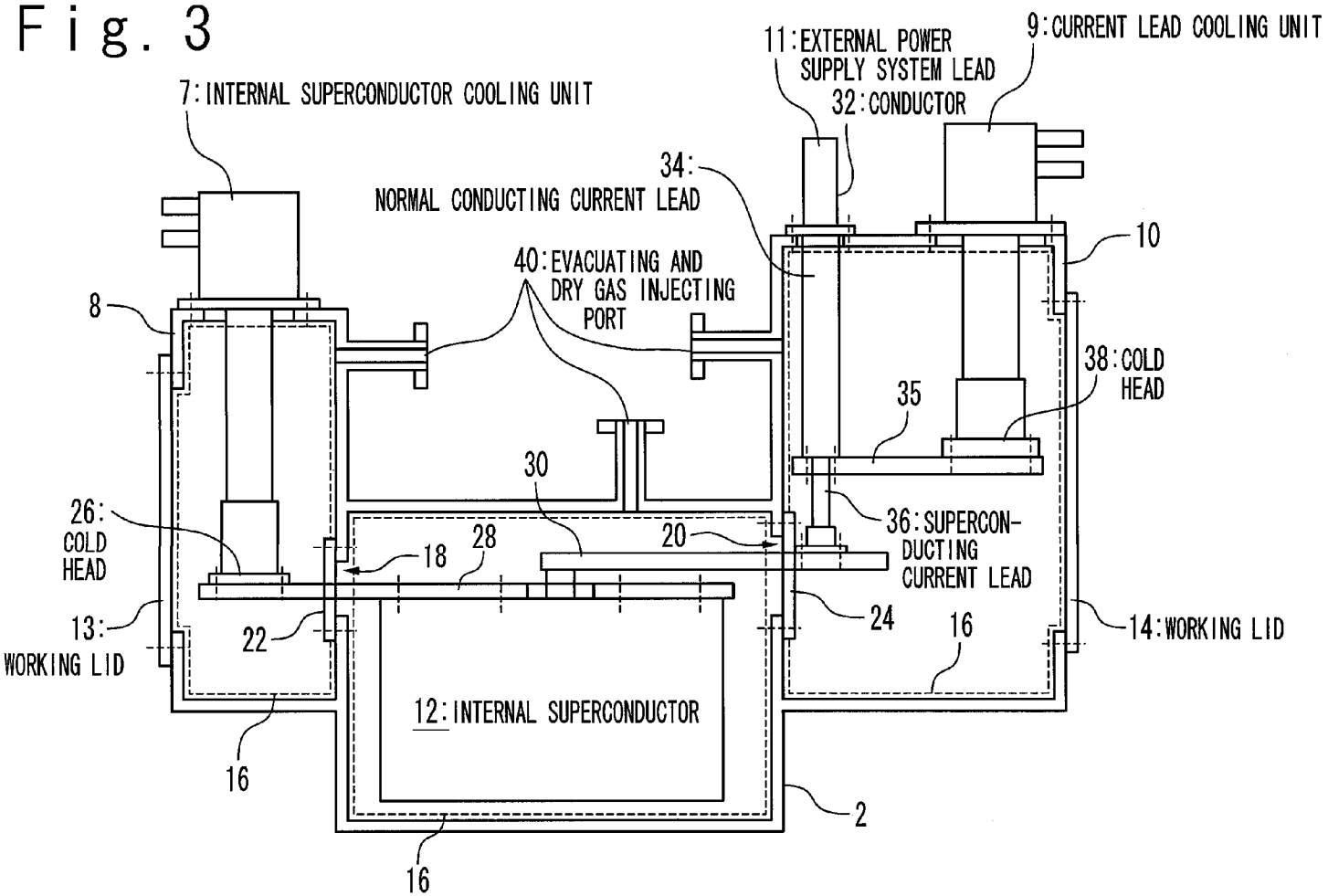
FIG. 3 is a diagram showing a superconduction apparatus in accordance with an embodiment of the present invention.

Hereinafter, a superconduction apparatus of the present invention will be described with reference to the attached drawings. FIG. 3 is a diagram showing a basic configuration of a superconduction apparatus 1. An internal superconductor 12 is accommodated in a vacuum adiabatic vessel 2 which is a first vacuum vessel. The inside of the vacuum adiabatic vessel 2 is covered with a radiation heat shield member 16. A vacuum adiabatic vessel 8 as a second vacuum vessel is contiguously connected to the vacuum adiabatic vessel 2. An internal surface of the vacuum adiabatic vessel 8 is covered with the radiation heat shield member 16. A gap 18 as a first connecting hole for connecting the inside of the vacuum adiabatic vessel 2 to the inside of the vacuum adiabatic vessel 8 is formed therebetween. A cold head 26 of an internal superconductor cooling apparatus 7 is arranged within the vacuum adiabatic vessel 8. The internal superconductor cooling apparatus 7 includes an ultra-low temperature refrigerator for cooling the internal superconductor 12 up to a temperature required to put the internal superconductor 12 into a superconducting state. The cold head 26 is connected to one end of a cooling conductor 28. The other end of the cooling conductor 28 is introduced into the inside of the vacuum adiabatic vessel 2 through the gap 18 and connected to the internal superconductor 12. A partition wall 22 through which the cooling conductor 28 passes is attached to a wall surface of the vacuum adiabatic vessel 8 in the gap 18. The partition wall 22 reduces a sectional area of the gap 18 surrounding the cooling conductor 28. The vacuum adiabatic vessel 8 has an openable working lid 13. The working lid 13 is attached to the vacuum adiabatic vessel 8 through a vacuum airtight seal, which prevents an external air from entering into the vacuum adiabatic vessel 8 when the lid 13 is closed.

A vacuum adiabatic vessel 10 as a third vacuum vessel is further provided adjacent to the vacuum adiabatic vessel 2. The internal surface of the vacuum adiabatic vessel 10 is covered with the radiation heat shield member 16. A gap 20 as a second connecting hole for connecting the inside of the vacuum adiabatic vessel 2 to the inside of the vacuum adiabatic vessel 10 is formed therebetween. A cold head 38 of a current lead cooling unit 9 is arranged within the vacuum adiabatic vessel 10. The cold head 38 is connected to one end of the cooling conductor 35 arranged within the vacuum adiabatic vessel 10. The other end of the cooling conductor 35 is combined with a normal conduction current lead 34 and a superconduction current lead 36 for cooling a connection between them. The other end of the normal conduction current lead 34 is connected to an external conductor 32 of the vacuum adiabatic vessel 10. An end of the conductor 32 is used as an external power supply interface 11. The external power supply interface 11 constitutes a current lead connecting terminal 6 shown in FIGS. 4 and 5. The other end of the superconduction current lead 36 is connected to one end of a conductor and cooling conductor 30. The other end of the conductor and cooling conductor 30 is introduced into the vacuum adiabatic vessel 2 through a gap 20 and connected to the internal superconductor 12. A partition wall 24 through which the conductor and cooling conductor 30 passes is attached to the wall surface of the vacuum adiabatic vessel 10 in the gap 20. The partition wall 24 reduces a sectional area of the gap 20 surrounding the conductor and cooling conductor 30. The vacuum adiabatic vessel 10 includes an openable working lid 14. The working lid 14 is attached to the vacuum adiabatic vessel 10 through a vacuum airtight seal, which prevents an outside air from entering into the vacuum adiabatic vessel 10 when the lid is closed. Each of the vacuum adiabatic vessel 2, the vacuum adiabatic vessel 8 and the vacuum adiabatic vessel 10 is provided with an evacuating and dry gas injecting port 40. The evacuating and dry gas injecting port 40 allows evacuation and injection of dry gas with respect to each of the vacuum adiabatic vessel 2, the vacuum adiabatic vessel 8 and the vacuum adiabatic vessel 10.

As described above, the superconduction apparatus in this embodiment is divided into the region in which the internal superconductor 12 is arranged and the region in which cooling heads such as the internal superconductor cooling apparatus 7 and the current lead cooling unit 9 are arranged. Such superconduction apparatus operates as follows. By evacuating through the evacuating and dry gas injecting port 40, the insides of the vacuum adiabatic vessel 2, the vacuum adiabatic vessel 8 and the vacuum adiabatic vessel 10 are made vacuous. The internal superconductor cooling apparatus 7 cools the internal superconductor 12 through the cooling conductor 28. The current lead cooling unit 9 cools the superconduction current lead 36 through the cooling conductor 35 to put the superconduction current lead 36 into the superconducting state. An external electrical apparatus is connected to the external power supply interface 11 to input/output electric power to/from the internal superconductor 12.

In the state that the gap 18 and the gap 20 are not narrow gaps and airtightly sealed in such a superconduction apparatus, when the internal superconductor cooling apparatus 7 is inspected or exchanged, dry gas is introduced through the evacuating and dry gas injecting port 40 provided on the vacuum adiabatic vessel 8 for vacuum break and only the internal temperature of the vacuum adiabatic vessel 8 is increased, thereby preventing freezing of the cooling conductor 28. After that, by opening the working lid 13, the internal superconductor cooling apparatus 7 in the vacuum adiabatic vessel 8 can be accessed. Thus, the internal superconductor cooling apparatus 7 can be inspected and exchanged without substantially exerting an effect on the vacuum adiabatic vessel 2 which accommodates the internal superconductor 12 therein. The current lead cooling unit 9, the superconduction current lead 36 and the normal conduction current lead 34 can be also inspected or exchanged by opening the working lid 14 in a similar fashion. In the inspecting or exchanging operation of the current lead and the cooling unit, vacuum break and temperature increase of the vacuum adiabatic vessel 2 in the internal superconductor 12 become unnecessary, and thus, the superconduction apparatus can be put into a reusable state in a short time.

When the gap 18 and the gap 20 are not airtightly sealed and are narrow gaps, vacuum break is performed by introducing dry gas through the evacuating and dry gas injecting port 40 of the vacuum adiabatic vessel 2 which accommodates the internal superconductor 12 therein. After that, by performing the above-mentioned operation, it is possible to suppress an increase in the temperature of the internal superconductor 12 and inspect and exchange the current lead and the cooling unit.

Figure 1:
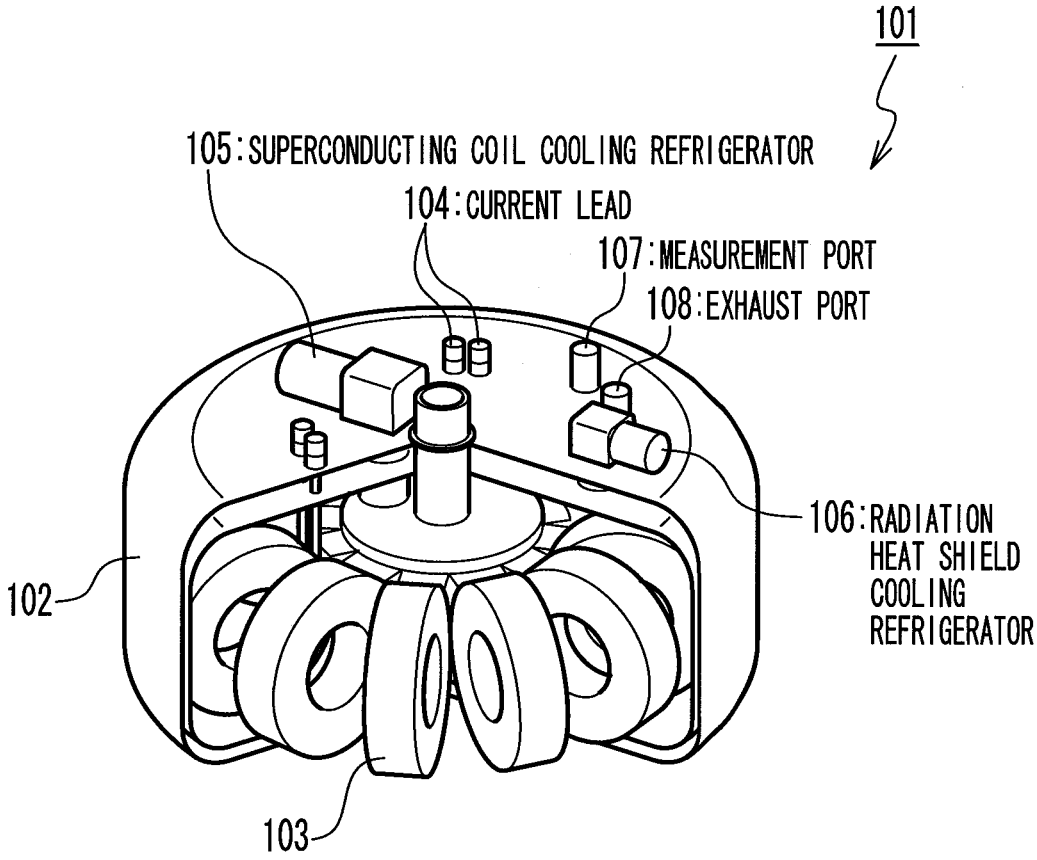
Fig. 1 CONVENTIONAL ART
FIG. 1 indicates a superconduction apparatus of a reference example for explaining the present invention.
Figure 2:
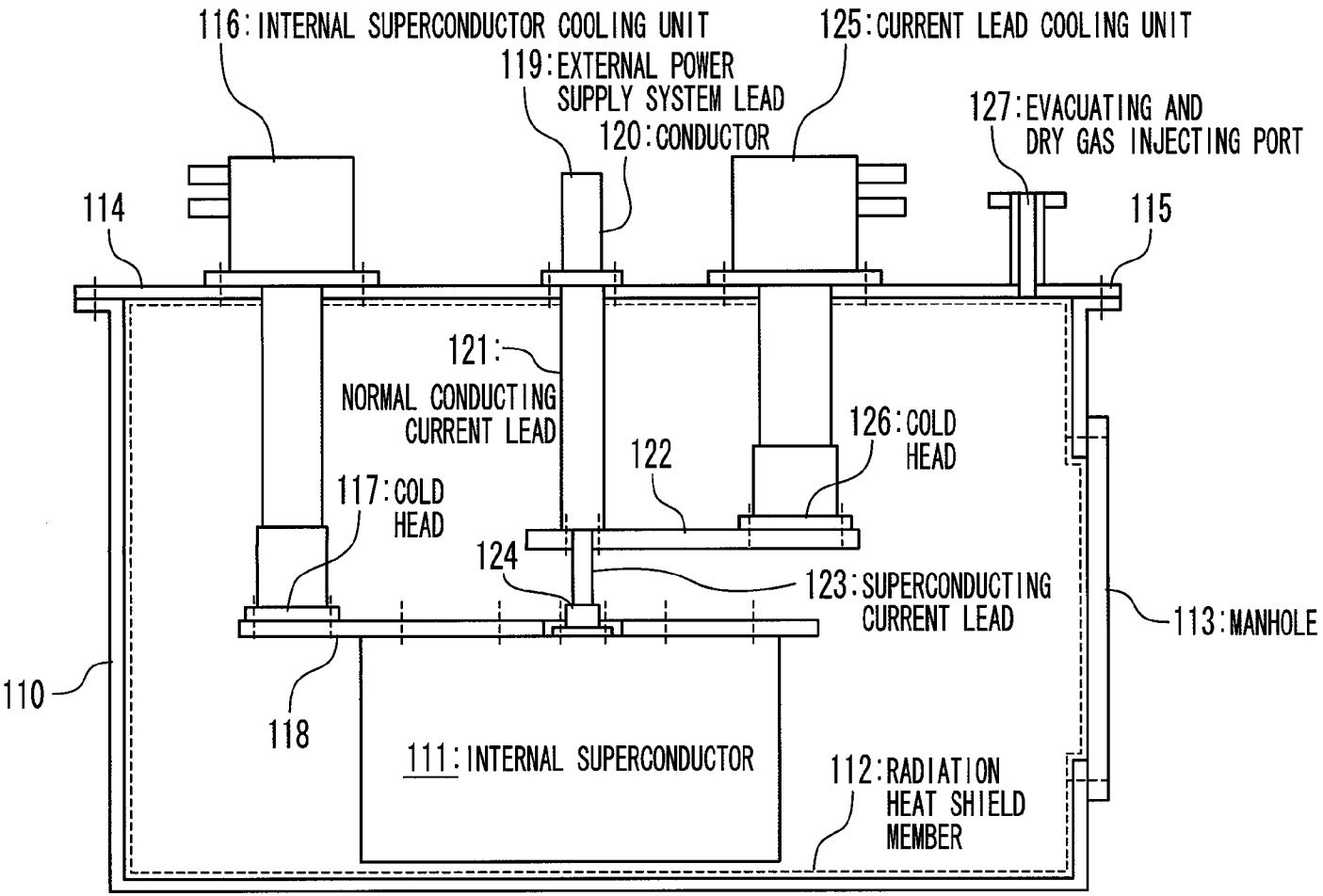
Fig. 2 CONVENTIONAL ART
FIG. 2 indicates a superconduction apparatus of a reference example for explaining the present invention.

By accommodating the ultra-low temperature refrigerator and the current lead in the vacuum adiabatic vessels 8 and 10, the capacity of the vacuum adiabatic vessel 2 which accommodates the internal superconductor 12 therein can be reduced. It is no need to provide a space for connecting the current lead and the cooling unit to the internal superconductor 111 in the vacuum adiabatic vessel 110 of the internal superconductor 111, as in the technique shown in FIG. 2. The size of the vacuum adiabatic vessel for a large internal superconductor can be reduced, thereby achieving reduction in size, weight and costs of the whole device. Thus, an element coil 4 as a superconductor is arranged within the vacuum adiabatic vessel 2 shown in FIG. 4. In the case of applying the superconduction apparatus, four internal superconductor cooling apparatuses 7 are arranged around the vacuum adiabatic vessel.

The cold heads of the internal superconductor cooling apparatuses 7 are accommodated in the vacuum adiabatic vessels 8-1 to 8-4, respectively. A current lead connecting terminal 6 is further attached to the vacuum adiabatic vessel 2. The current lead connecting terminal 6 is a terminal for electrically connecting the element coil 4 to the external apparatus. The current lead cooling unit 9 is mounted in correspondence to the current lead connecting terminal 6. The cold head of the current lead cooling unit 9 is accommodated in the vacuum adiabatic vessel 10.

Figure 4:
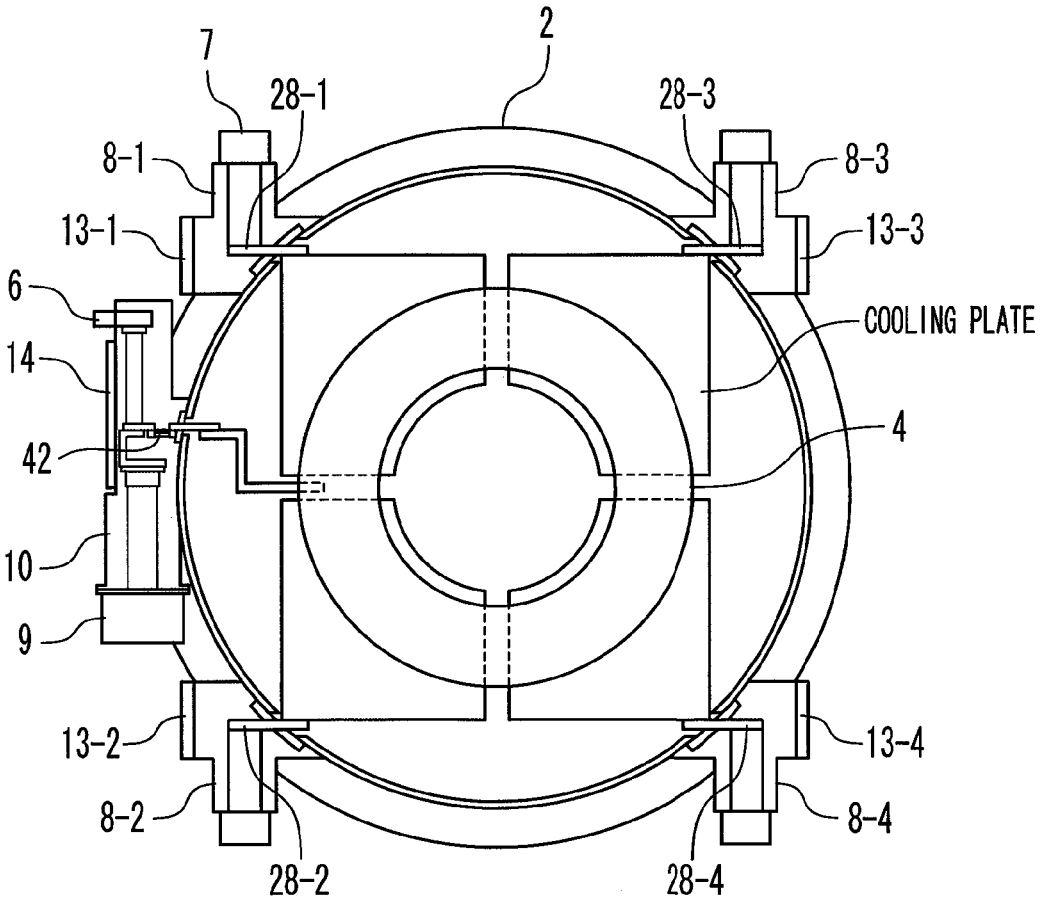
FIG. 4 is a diagram showing the superconduction apparatus in accordance with an embodiment of the present invention.

FIG. 4 is a sectional view showing an example of an apparatus employing the configuration of the superconduction apparatus shown in FIG. 3. The element coil 4 in FIG. 4 corresponds to the internal superconductor 12 in FIG. 3. The vacuum adiabatic vessels 8-1 to 8-4 correspond to the vacuum adiabatic vessel 8.

With respect to conduction cooling of the internal superconductor 12, approach from the entire circumference of the vacuum adiabatic vessel 2 at a small distance becomes possible. For this reason, as shown in FIG. 4, it is possible to cool one internal superconductor 12 by many internal superconductor cooling apparatuses 7. As a result, even an ultra-low temperature refrigerator with small capability can cool the internal superconductor 12 evenly and with a large capacity.

Concerning a coil apparatus having a larger capacity, the capacity of the coil apparatus can be easily increased by employing a configuration that the coil apparatus is divided into a plurality of coils having cooling units on the whole outer circumstance and laminating combinations of the coils and the cooling units, in view of a condition of basically requiring axial magnetic coupling between coils. Toroidal coils shown in FIG. 5 as an example of such a coil apparatus can obtain a same result. In other words, by employing the lamination configuration of the plurality of coils which form pairs of the cooling units, the coil apparatus including vacuum adiabatic vessels can be divided at boundaries of lamination and integrated by combination.

Figure 5:
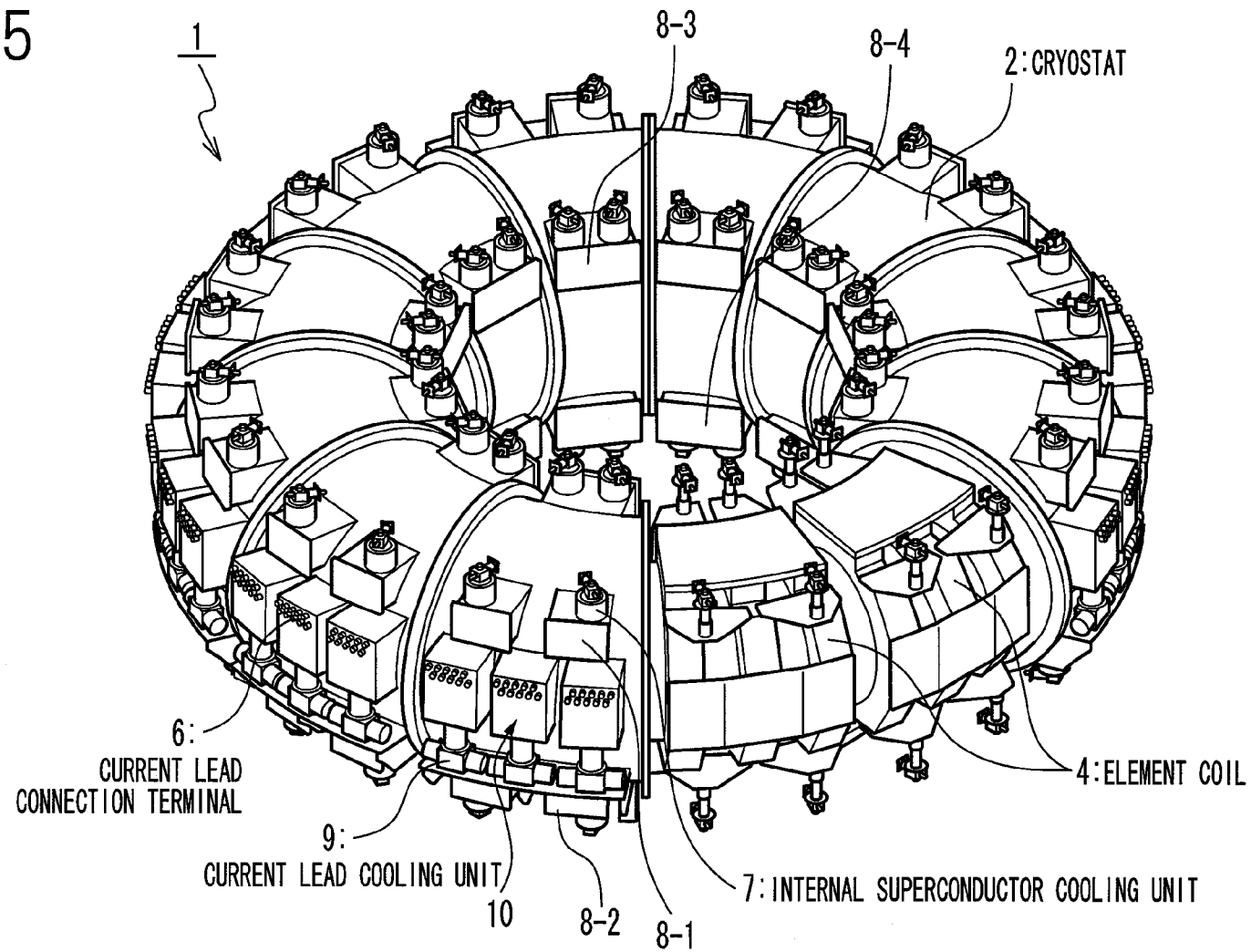
FIG. 5 is a diagram showing the superconduction apparatus in accordance with an embodiment of the present invention.

FIG. 5 shows a superconduction apparatus 1 realized by applying this embodiment. In this embodiment, the superconduction apparatus 1 is a SMES (Superconducting Magnetic Energy Storage). The superconduction apparatus 1 includes a plurality of vacuum adiabatic vessels (cryostats) 2 which are annularly arranged. The plurality of vacuum adiabatic vessels 2 can be connected or disconnected to or from each other. An element coil 4 of a toroidal coil type is arranged within each of the vacuum adiabatic vessels 2. In FIG. 5, a part of the vacuum adiabatic vessels 2 is not illustrated to expose the element coils 4 in the vacuum adiabatic vessels 2. Operational lids 13-1 to 13-4 and cooling conductors 28-1 to 28-4 in FIG. 5 correspond to the working lids 13 and the cooling conductor 28 in FIG. 3, respectively. In this superconduction apparatus 1, as described as shown FIG. 3, the cooling units can be maintained and exchanged by opening the working lids 13-1 to 13-4, 14 even if vacuum break or temperature increase of the whole apparatus is not performed.

Figure 6:
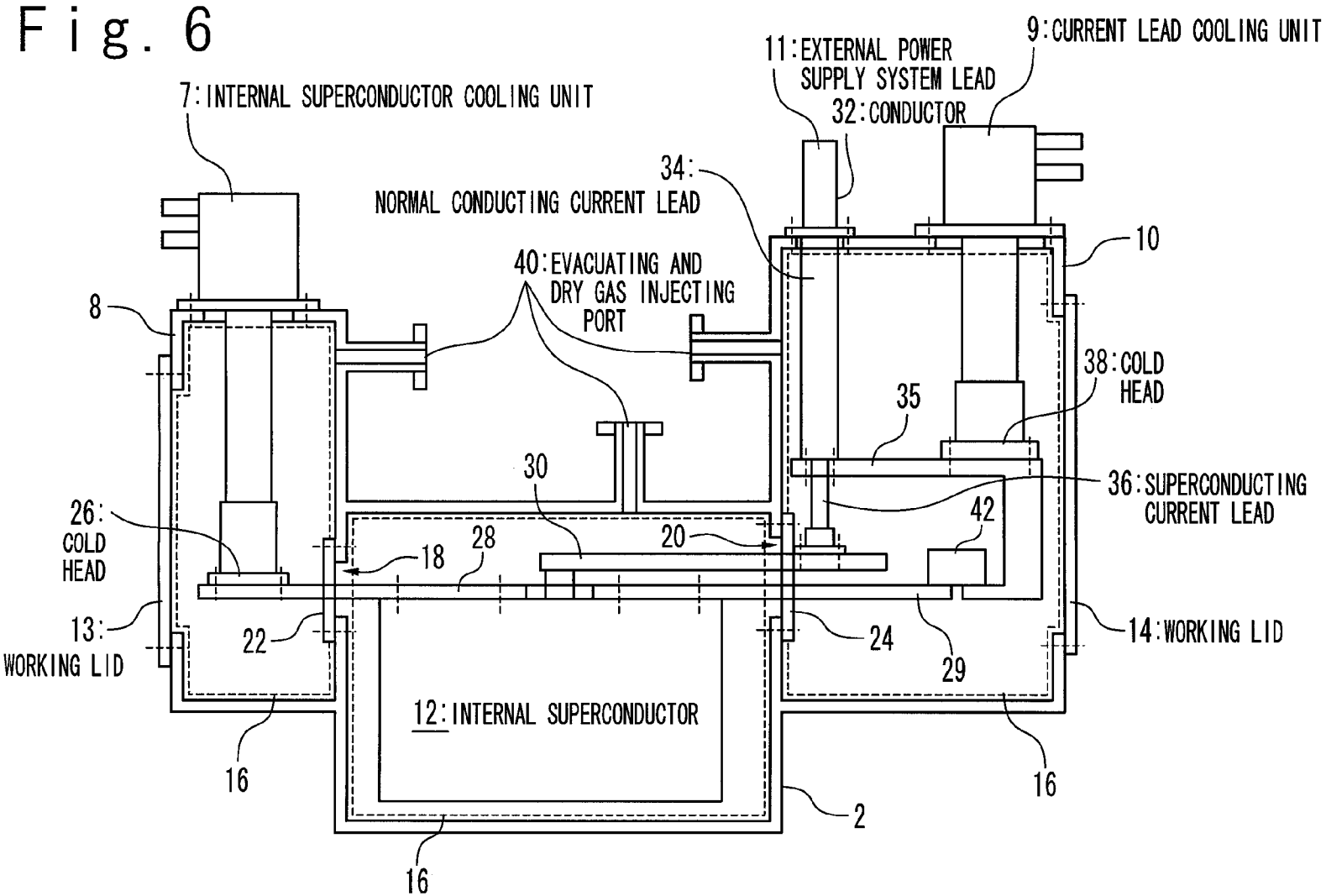
FIG. 6 is a diagram showing the superconduction apparatus in accordance with an embodiment of the present invention.

FIG. 6 shows a configuration of a superconduction apparatus in another embodiment. As compared with the apparatus in FIG. 3, an end of the cooling conductor 28 on a side of the current lead is extended and arranged within the vacuum adiabatic vessel 10 through the gap 20. A switch 42 for switching ON/OFF (connection/disconnection) between the cooling conductor 35 and the cooling conductor 28 from the outside of the apparatus is further provided. Since such a superconduction apparatus can use the current lead cooling unit 9 in addition to the internal superconductor cooling apparatuses 7 by connecting the switch 42 to cool the internal superconductor 12, a cooling time is reduced.

What is claimed is:

1. A superconduction apparatus, comprising:

a superconductor;

a first vacuum vessel configured to accommodate said superconductor;

a cooling unit which comprises a cold head configured to generate a temperature at which said superconductor is set to a superconducting state;

a second vacuum vessel configured to accommodate said cooling unit and said cold head;

a first cooling conductor connecting said cold head and said superconductor for cooling said superconductor by said cold head through said first cooling conductor, said first cooling conductor extending through a first connection hole which communicates said first vacuum vessel and said second vacuum vessel;

a current lead configured to electrically connect said superconductor with an external terminal;

a current lead cooling unit configured to cool said current lead;

a third vacuum vessel provided to apart from said second vacuum vessel and configured to accommodate said current lead and said current lead cooling unit;

a vacuum unit configured to evacuate each of said first vacuum vessel, said second vacuum vessel and said third vacuum vessel individually, and inject a dry gas into each of said first vacuum vessel, said second vacuum vessel and said third vacuum vessel individually;

a second cooling conductor connecting said current lead and said superconductor and extending through a second connection hole which communicates said first vacuum vessel and said third vacuum vessel; and a switch provided in said third vacuum vessel to be controllable from outside the apparatus and configured to connect or disconnect said current lead cooling unit to or from the second cooling conductor which further extends through the second connection hole into the third vacuum vessel, wherein the current lead is put to the superconducting state by being cooled by the current lead cooling unit, an electric power is input to and output from the superconductor via the current lead, and the apparatus is configured such that when the switch is turned off, the current lead cooling unit cools the current lead to the superconducting state, and when the switch is turned on, the current lead cooling unit cools also the superconductor.

2. The superconduction apparatus according to claim 1, further comprising:

a partition wall provided to decrease an opening area of said first connection hole.

3. The superconduction apparatus according to claim 1, further comprising:

a hermetic seal provided to seal said first connection hole to seal a vacuum in one of said first vacuum vessel and said second vacuum vessel from dry gas introduced into the other of said first vacuum vessel and said second vacuum vessel.

4. The superconduction apparatus according to claim 1, wherein said second vacuum vessel comprises an openable lid, and said third vacuum vessel comprises another openable lid.

5. The superconduction apparatus according to claim 1, wherein:

the first vacuum vessel has different first and second sides; and the second vacuum vessel is connected to the first side of the first vacuum vessel at the first connection hole, and the third vacuum vessel is connected to the second side of the first vacuum vessel at the second connection hole.

6. The superconduction apparatus according to claim 1, further comprising:

a hermetic seal provided to seal said second connection hole to seal a vacuum in one of said first vacuum vessel and said third vacuum vessel from the dry gas introduced into the other of said first vacuum vessel and said third vacuum vessel.

7. The superconduction apparatus according to claim 1, wherein the second cooling conductor is a solid cooling conductor.

8. The superconduction apparatus according to claim 1, wherein the second cooling conductor is also an electrical conductor.

9. The superconduction apparatus according to claim 1, wherein the first cooling conductor is a solid cooling conductor.

10. The superconduction apparatus according to claim 1, wherein the first vacuum vessel directly accommodates said superconductor without liquid coolant.

11. A superconduction apparatus, comprising:

a superconductor;

a first vacuum vessel configured to accommodate said superconductor;

a cooling unit which comprises a cold head configured to generate a temperature at which said superconductor is set to a superconducting state;

a second vacuum vessel configured to accommodate said cooling unit and said cold head;

a first cooling conductor connecting said cold head and said superconductor for cooling said superconductor by said cold head through said first cooling conductor, said first cooling conductor extending through a first connection hole which communicates said first vacuum vessel and said second vacuum vessel;

a current lead configured to electrically connect said superconductor with an external terminal;

a current lead cooling unit configured to cool said current lead;

a third vacuum vessel provided to apart from said second vacuum vessel and configured to accommodate said current lead and said current lead cooling unit;

a vacuum unit configured to evacuate each of said first vacuum vessel, said second vacuum vessel and said third vacuum vessel individually, and inject a dry gas into each of said first vacuum vessel, said second vacuum vessel and said third vacuum vessel individually;

a second cooling conductor connecting said current lead and said superconductor and extending through a second connection hole which communicates said first vacuum vessel and said third vacuum vessel; and a switch provided in said third vacuum vessel to be controllable from outside the apparatus and configured to connect or disconnect said current lead cooling unit to or from the second cooling conductor which further extends through the second connection hole into the third vacuum vessel, wherein the apparatus is configured such that when the switch is turned off, the current lead cooling unit cools the current lead to the superconducting state, and when the switch is turned on, the current lead cooling unit cools also the superconductor.

* * * * *